US005452189A

United States Patent [19]

Alkjaer

[11] Patent Number: 5,452,189

[45] Date of Patent: Sep. 19, 1995

[54] LAMP FOR A LIFE JACKET OR RAFT

[75] Inventor: Hans P. Alkjaer, Slangerup Overdrev, Denmark

[73] Assignee: Daniamant ApS, Slangerup, Denmark

[21] Appl. No.: 68,793

[22] Filed: Jun. 1, 1993

[30] Foreign Application Priority Data

Jun. 2, 1992 [DK] Denmark ..... 738/92

[51] Int. Cl.[6] ..... F21V 33/00

[52] U.S. Cl. ..... 362/253; 362/103; 362/158; 362/203; 441/36; 441/89

[58] Field of Search ..... 441/16, 18, 36, 89, 441/90; 362/103, 108, 158, 186, 187, 188, 196, 203, 204, 253

[56] References Cited

U.S. PATENT DOCUMENTS

| | | | |
|---|---|---|---|
| 2,110,596 | 3/1938 | Gaede | 441/16 |
| 2,132,510 | 10/1938 | Goertzen | 362/253 |
| 2,263,518 | 11/1941 | Riner | 362/186 |
| 2,355,247 | 8/1944 | Slocum | 362/186 |
| 2,366,929 | 1/1945 | Pfeil | 362/158 |
| 2,908,101 | 10/1959 | Butler et al. | 362/253 |
| 2,947,105 | 8/1960 | Lagios | 362/203 |
| 3,065,337 | 11/1962 | Torgerson | 362/191 |
| 3,618,150 | 11/1971 | Anselmi | 441/16 |
| 3,638,258 | 2/1972 | Black | 362/108 |
| 4,234,913 | 11/1980 | Ramme | 362/158 |
| 4,405,303 | 9/1983 | Smith | 441/16 |
| 4,873,933 | 10/1989 | Bennett et al. | 441/36 |

*Primary Examiner*—Ira S. Lazarus
*Assistant Examiner*—Alan B. Cariaso
*Attorney, Agent, or Firm*—Watson, Cole, Grindle & Watson

[57] ABSTRACT

A lamp for a life jacket or raft is provided with a battery box (1,2) having a battery (7) and a light source (9) arranged in a lamp housing (6). The lamp may be switched on and off by screwing the lamp housing on and off. At its perphery the rotatable lamp housing (6) is provided with one or more line attachment means in the form of teeth (13) on a toothed ring (12), and a line (14) is releasably attached to one of the teeth so that a pull in the line will cause the lamp housing (6) to rotate and thus to switch on the lamp, following which the line is automatically released from the lamp housing.

9 Claims, 4 Drawing Sheets

LAMP FOR A LIFE JACKET OR RAFT

BACKGROUND OF THE INVENTION

The present invention relates to a lamp for a life jacket or raft having a battery box which contains a battery and a light source located in a lamp housing wherein the lamp is switched on and off by screwing and unscrewing, respectively, of the lamp housing. The lamp may be used for inflatable as well as non-inflatable rigid life jackets and rafts.

Life jackets and rafts which are held in readiness aboard vessels and aircraft are usually in a tightly packed condition until inflated for use. The inflation is preferably carried out automatically even though it may also be carried out manually. For being put into use, the lamp arranged on the life jacket or raft is to be switched on by supplying power from a long-storage-life battery. The lamp may be switched on manually but, of course, it is desirable that it is switched on automatically, and in a known lamp which is switched on automatically a switch is inserted into the current supply circuit of the lamp and consists of contact springs which, in the deactivated condition of the lamp, are kept apart by a plastic pin which, using a line fixed to an anchoring site on the life jacket or raft, upon inflation of the jacket or raft, provides a pull on the line for pulling out the plastic pin so as to permit the contact springs to contact each other and thus close the circuit to the lamp. It is a drawback of such an inserted switch that, in use, it is not protected against the environment so that poor contacting may occur. It is also a drawback of the known construction that such an additional switch should be provided which increases the price of the assembly as such. Of course, the same also applies when the lamp is used on a non-inflatable life jacket or raft where it is switched on manually.

SUMMARY OF THE INVENTION

It is the object of the present invention to provide a lamp of the type described initially which provides reliable contact making in a simple and inexpensive way and according to the invention this is achieved by providing the rotatable lamp, housing at its periphery with a line attachment means and by connecting an automatically releasable line to the attachment means.

Hereby is obtained that a pull exerted on the line and which may be effected manually or, in inflatable life jackets or rafts, automatically upon inflation, immediately effects the requisite screwing of the lamp housing for switching on the lamp as the terminals of the light source are hereby brought into connection with the relevant contact means in the lamp in a manner known per se. The automatic release of the line from the attachment means ensures a desired screwing of the lamp housing and the contact points are well protected inside the lamp, which is generally of a waterproof construction.

In a convenient embodiment of the lamp according to the invention the attachment means comprises a ring provided on the lamp housing and having several attachment means. It will thus be particularly simple to provide the desired degree of screwing when switching on the lamp.

In order to protect the lamp from unintentional switching-on in its ready-for-use state, which state often extends over several years, the lamp may have a line guide means in which the line is releasably secured in the ready-for-use state of the life jacket or raft. Such line guide means may conveniently be constituted of an eye with a plug which fits therein and is made from of a flexible material which, by an initial pull in the line for switching on the lamp, is easily removed from the eye to permit the free passage of the line therethrough. Furthermore, the plug ensures that the line is kept tight during storage and assembly so that it cannot fall off the attachment means on the lamp housing.

The attachment means on the lamp housing may be in the form of teeth-shaped protrusions. Thus, in a simple manner a high degree of certainty is obtained that, following the desired rotation of the lamp housing, the line is released therefrom at the desired point in the rotation movement.

In another advantageous embodiment of the lamp the line attachment means is a line retaining means having an opening for releasing the line when the line retaining means is positioned substantially opposite to a line guide means on the battery box and co-operating means are provided on the lamp housing and battery box, respectively, for retaining the lamp housing in its ready-for-use position until a sufficient force is imparted to the lamp housing to surmount the retaining force of the co-operating means. The line-retaining means will hold the line until it is automatically released through the opening when a pull in the line has caused the lamp housing to rotate sufficiently to bring the opening close to the line guide means, in which position the lamp has been switched on.

In order to simplify and reduce the cost of the entire lamp, the lamp according to the invention may have contact springs which are each in one piece and make contact with a battery pole and a lamp terminal and the one contact spring may be so designed and arranged that it acts both as an actual contact means and as a return spring for the light source.

The lamp housing is preferably designed with an abutting surface for a ring which is present on the light source, thereby ensuring that the light source is always in the correct position relative to the lamp housing which is optically very important as the lamp housing is often designed with a lens which is to be positioned accurately relative to the filament of the light source.

The one contact spring is conveniently designed to keep the light source in permanent contact with the lamp housing during its rotation whereby the light source is rotated simultaneously, thus allowing for an abrasive effect on the contact surfaces of the contact springs so as to make the transition resistance thereto small.

According to a further embodiment, the upper end of the lamp housing is provided with a removable lens ring which, with low mould and production costs, permits the use of the lamp housing with as well as without a lens.

DESCRIPTION OF THE PREFERRED EMBODIMENTS

Figure 1:
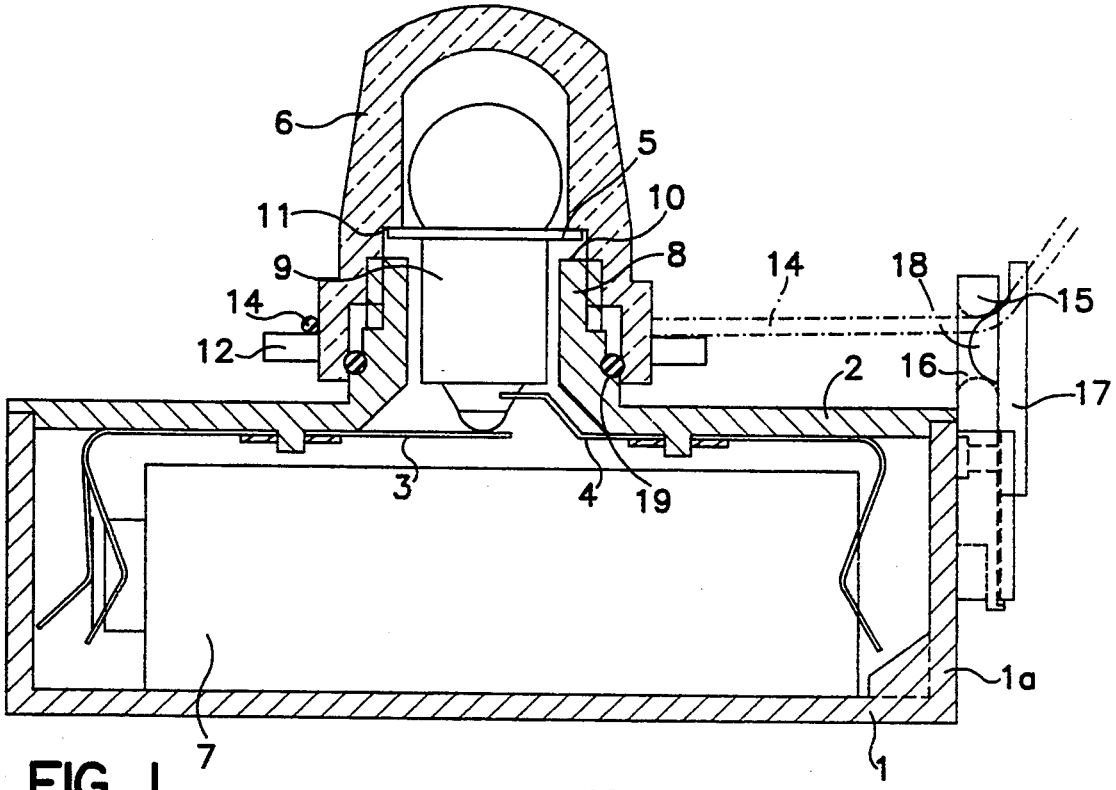
FIG. 1 shows an embodiment of a lamp according to the invention for use on a life jacket or raft, as seen in a section along the line I—I of FIG. 2.
Figure 2:
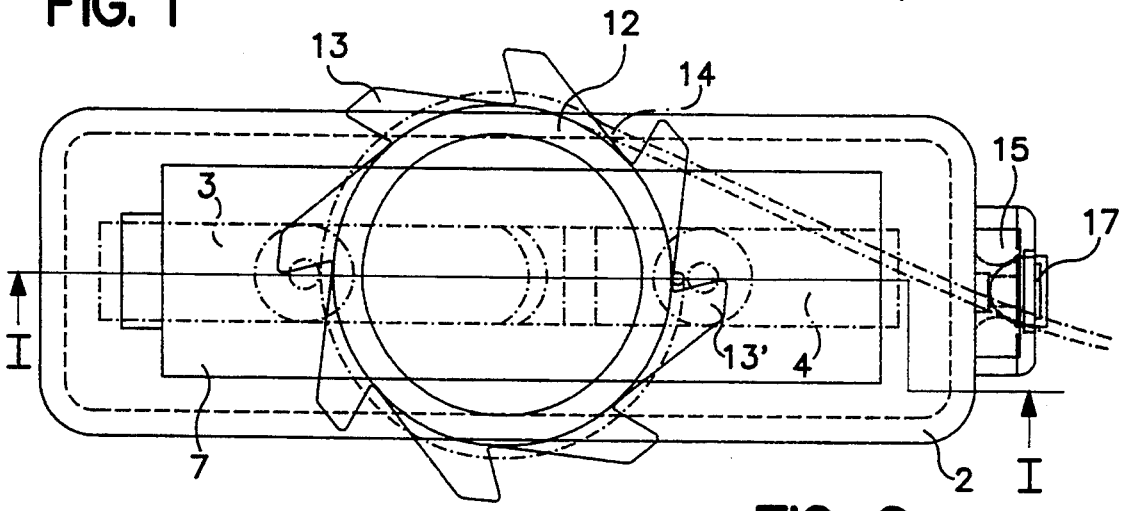
FIG. 2 shows a plan view of the lamp of FIG. 1 seen from above.
Figure 3:
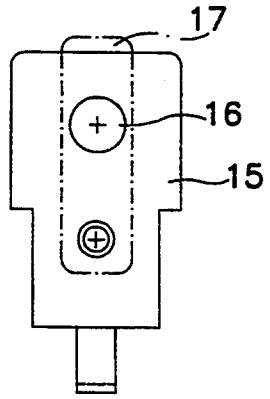
FIG. 3 shows a detail of the lamp shown in FIGS. 1 and 2, FIGS. 4 and 5 show views corresponding to FIGS. 1 and 2 of a first variant of the lamp shown in these Figures.

In the drawings FIGS. 1 and 2 depict a waterproof lamp comprising a battery box 1 which contains a long-storage-life battery 7, the battery box being closed with a cover 2 provided with a socket 8 having an external thread which extends away from the housing. The box 1 is provided with a left and a right contact spring 3 and 4, respectively, which are each in one piece and make contact with a respective battery pole and a respective lamp terminal on a light source in the form of a low-voltage lamp 9 on which a seeger-ring or a self-locking toothed ring 5 is secured. A transparent lamp housing 6 is provided with an internal thread for being screwed onto the socket 8 after the lamp 9 has been inserted into the socket. For the ring 5 abutting surfaces 10 and 11 are provided on the socket 8 and the lamp housing 6, respectively.

The lamp housing 6 supports a toothed ring 12 which is provided with teeth 13 which are inclined opposite to the screwing direction of the lamp housing, clockwise as seen in the view in FIG. 2. A line 14 is passed around the lamp housing 6 located above the toothed ring 12 and with a loop it is connected to one of the teeth of the toothed ring, and in FIG. 2 the relevant tooth around which the line is passed is denoted 13'. The line 14 is passed through an eye 16 in a line guide means 15 which is secured to the end of the battery housing 1*a* and extends in the same direction as the socket 8, as will appear from FIGS. 1 and 2. At its one end a rubber plug 17 is secured to the line guide means 15 and is provided with a protrusion 18 which may be squeezed into and secured in the eye 16 for concurrently keeping the line 14 tight between the lamp housing and the line guide means so that it does not unintentionally fall off the tooth 13' to which it is connected. The rubber plug 17 has the additional function that, when suitably designed, it has the effect that an unintentional pull or impact on the line towards the lamp housing presupposes a more powerful pull to release the line than a pull in the switching-on direction for the lamp. Thereby a high degree of security is obtained that the line stays in place. In case of an inflatable life jacket or raft, the other end of the line 14 may be secured to an anchoring site on the life jacket or raft which in the inflated state thereof is positioned at a greater distance from the lamp than the length of the line.

The lamp is switched on and off by screwing and unscrewing of the lamp housing 6 onto and off the socket 8. The lamp design is such that one terminal of the lamp 9 permanently abuts the contact spring 3, which thus keeps the lamp 9 pressed upwards so that the ring 5 abuts the abutting surface 11. When screwing on the housing the second terminal of the lamp 9 is moved downwards into engagement with the spring 4 to close the circuit from the battery. It will appear that the spring 3 acts both as an actual contact means and as a return spring for the lamp, thereby eliminating the need for a separate spring (most often a helical spring) whose only function is to urge the contacts away from each other when the contact system is to be disconnected.

When taking an inflatable life jacket or raft into use, a powerful pull on the line 14 is immediately exerted during inflation, thereby pulling it somewhat out through the eye 16 and thus the rubber plug 17 which is mounted on the outside of the line guide means 15 is pulled away from the eye so that the line is no longer secured. When the pull in the line is continued the toothed ring 12 and thus the lamp housing 6 is rotated clockwise as seen in FIG. 2 for further screwing on of the lamp housing and hence for switching on the lamp. The rotation movement of the lamp housing continues until the tooth 13' almost faces the line guide means, whereby the line will immediately be released from the tooth which is inclining backwards. It will be appreciated that this line release position of the toothed ring 12 is more or less predictable and therefore the desired rotation movement of the lamp housing 6 is easily determined by the positioning of the line behind a tooth 13. In case of a non-inflatable life jacket or raft, the lamp is switched on in the same manner by a manual pull in the line.

The line guide means 15 with the plug 17 constitutes a safety measure which may optionally be omitted.

Figure 4:
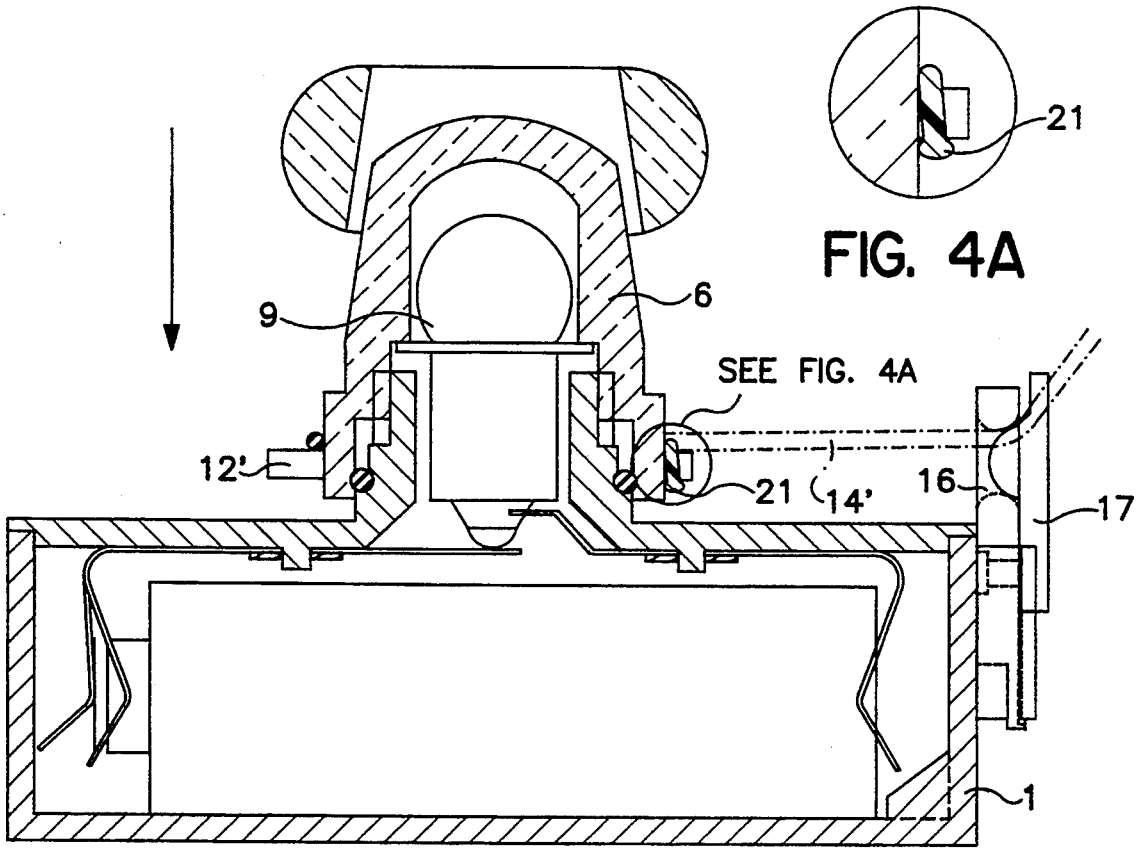
Figure 5:
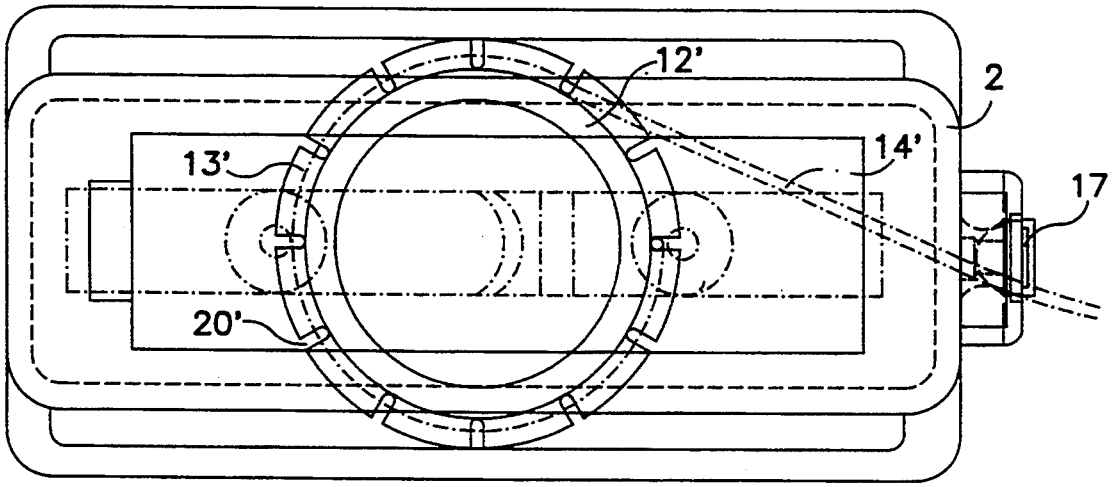

The first variant of the lamp of FIG. 1 shown in FIGS. 4 and 5 comprises more or less the same components as the latter, the toothed ring 12', however, being modified in that its teeth 13' are straight and narrowly spaced apart 20. Thereby it is permitted that a line 14' which is provided with a knob 21 at its end may be secured in the tooth space 20. Such a knob 21 may for instance be formed by heating of the end of a line made from plastics, e.g. nylon. When the lamp is switched on, the line knob 21 may, following the release thereof from the toothed ring 12', more readily pass through the eye 16 than the loop mentioned above. Additionally, this construction results in a more elegant design of the lamp housing.

FIG. 4 further depicts a lens ring 22 which is designed such that it is readily mounted on and removed from the lens housing 6 as they are provided with an internal and external conus, respectively, which fit each other exactly so that the lens ring 22 is secured in its position facing the filament of the lamp 9. Thus, it has been made possible in a simple manner with low mould and production costs to use the lamp housing both with and without a lens and at the same time the problem has been eliminated that it is difficult or impossible to injection-mould a lamp housing with lens without suctions occurring at places where the wall thickness is greatest which would give rise to undesired reflexes and loss of light intensity.

Figure 6:
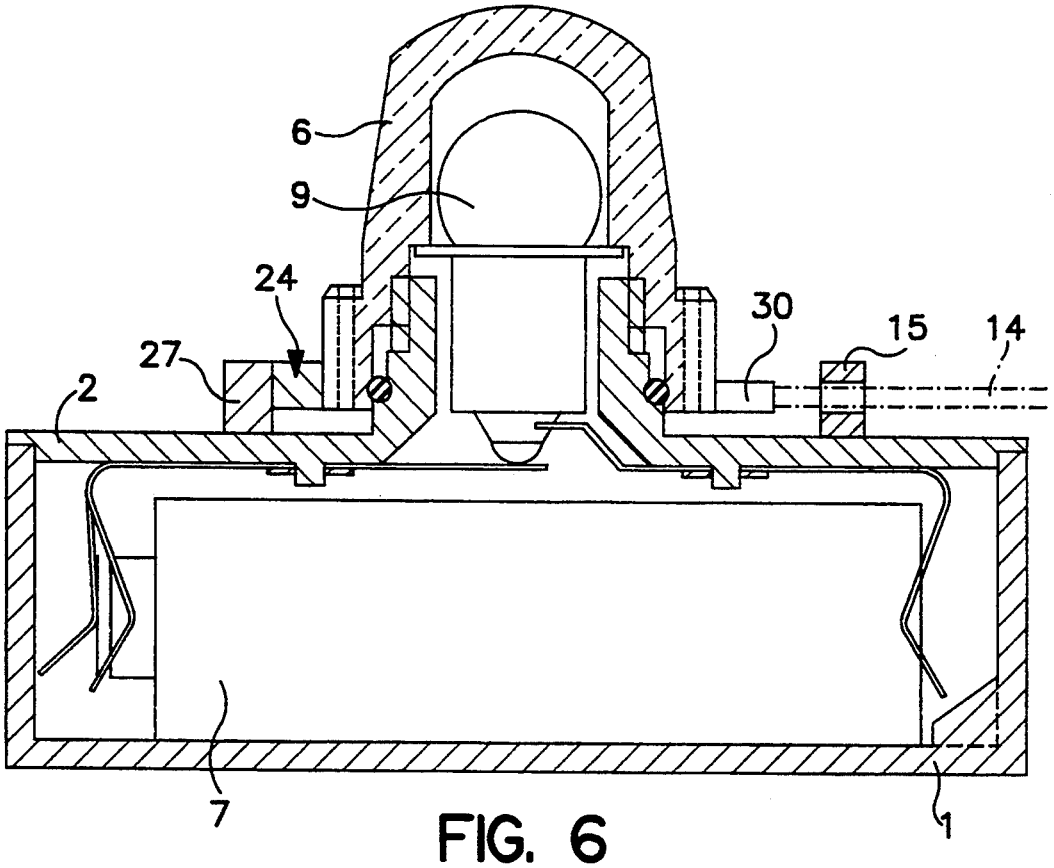
FIGS. 6 and 7 show views corresponding to FIGS. 1 and 2 of a second variant of the lamp shown in these figures, FIGS. 8 and 9 respectively show a lamp according to the invention attached to an uninflated and to an inflated life raft.
Figure 7:
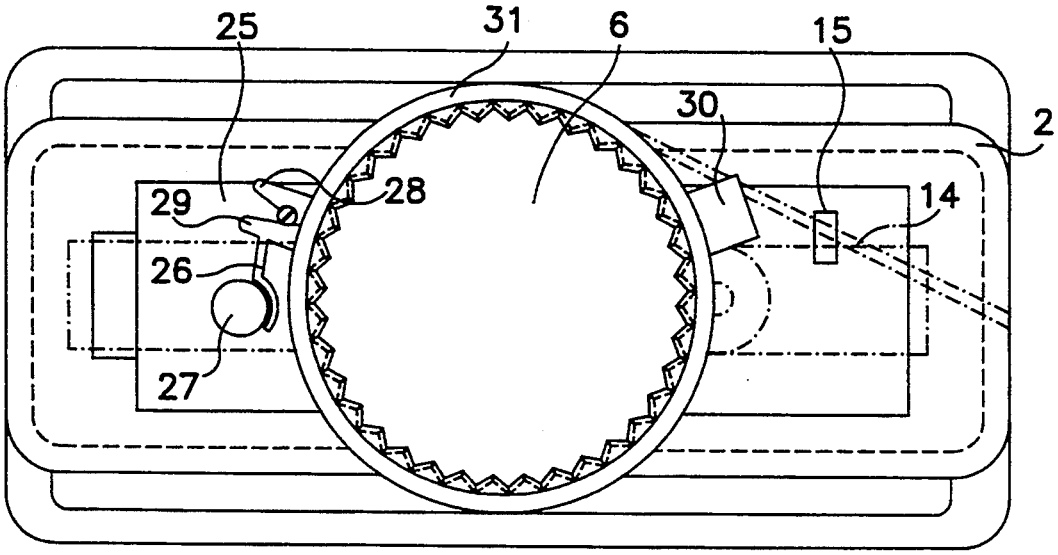
Figure 9:
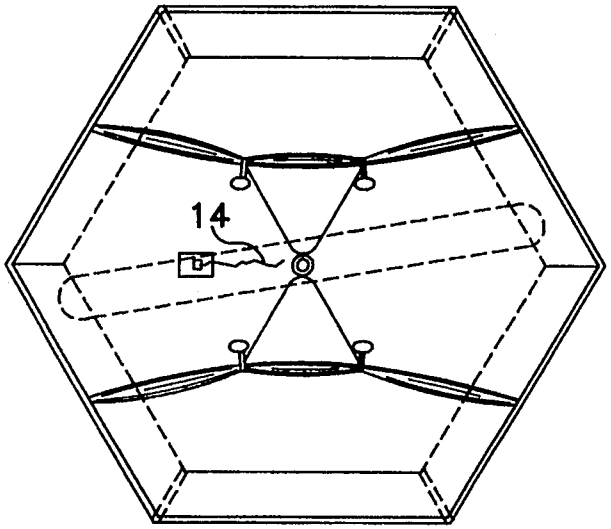
Figure 8:
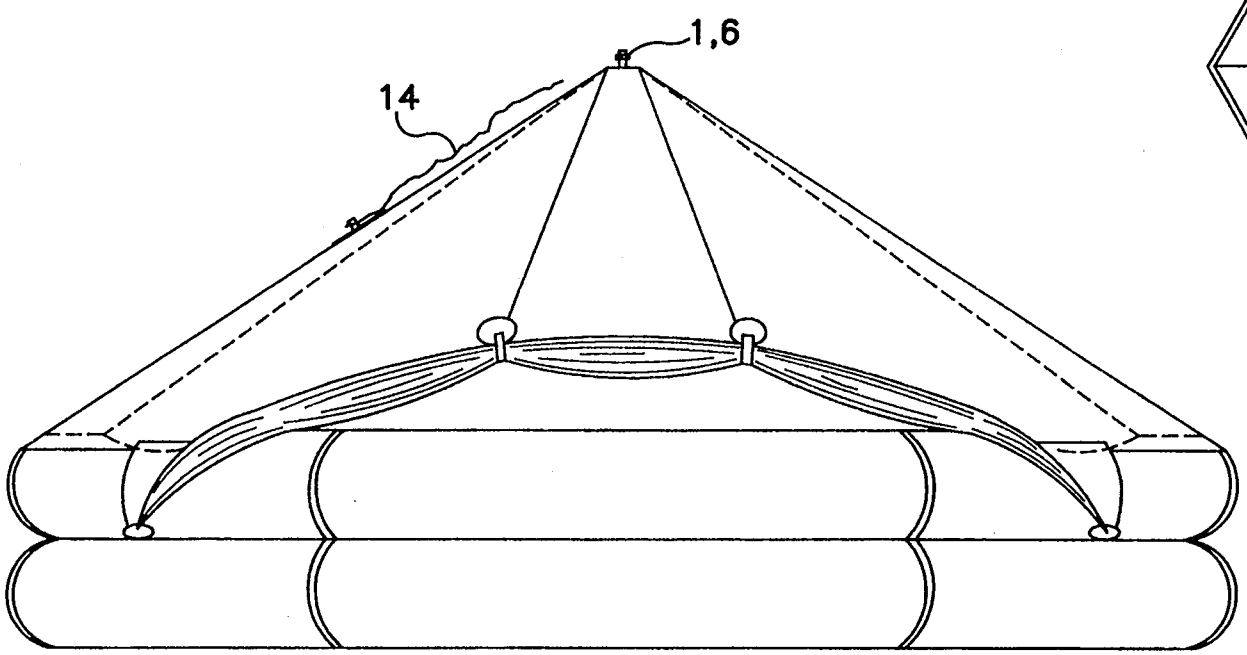

The second variant of the lamp of FIGS. 1 and 2 which is shown in FIGS. 6 and 7 also primarily consists of the same components as the former, however, instead of a toothed ring the lamp housing 6 is here provided with a single line-retaining means 24 in which the end of the line 14 is secured between two jaws 28,29. Between the jaws there is an opening 25 through which the line is inserted to be engaged in the retaining means. From the retaining means 24 the line is passed around the lamp housing 6 and from there outwards and through the eye of a line guide means 15 on top of the battery box 1,2. Here the line is freely movable in the line guide means. The lamp housing 6 and the battery box 1,2 are provided with co-operating rotation inhibiting means in the form of a curved arm 26 on the line-retaining means 24, which engages with a stud 27 on the battery box. In the engaged position the lamp housing 6 is held in the ready-for-use position of the lamp and when a sufficient pull is exerted on the line 14 the engaging force of the components 26 and 27 is surmounted, so that the lamp housing is rotated until the retaining means is located such as to almost face the line guide means 15. In this position the pull in the line will cause the line to be released from the line-retaining means and pulled out through the opening 25 thereof. The rotation of the lamp housing 6 may be restricted by a projection 30 on the lamp housing periphery or by means of the line-retaining means 24 when the projection or the retaining means abuts the stud 27 on the battery box by the continued rotation of the lamp housing. In the embodiment shown in FIGS. 6 and 7 the line-retaining means 24, 26, 28, 29 and the projection 30 are provided on a ring 31 which is press fitted onto the serrated conical outer surface of the lower portion of the lamp housing 6 as best shown in FIG. 7.

It will 11 appear that the lamp suggested comprises very few components and constitutes a completely tight assembly as the lamp housing is sealed against the socket 8 by a packing ring 19. The contact points where the contact is made are thus always well protected, the abrasive effect on the contact surfaces of the springs 3 and 4 which occurs when the lamp housing rotates, and the transition resistance to the springs is always low so i.e., a high degree of security is obtained, that the lamp functions automatically even after several years in its ready-for-use state.

I claim:

1. An electric lamp which can be turned on by a line means connected to a life jacket or raft, said lamp comprising:

a battery box, said battery box including a housing for a battery and a threaded socket which extends away from the battery housing in a first direction, a line guide means which extends away from the housing in said first direction, a lamp housing containing electric light-source means, said lamp housing defining threads engaged with said threaded socket to enable said lamp housing to be screwed towards said battery housing from a first position where electricity from a battery in said battery housing cannot flow to said light-source means to a second position where electricity will flow to said electric light-source means to turn on said electric light-source means, an attachment means positioned around said lamp housing, and a line means which passes through said line guide means and is releasably connected to said attachment means for rotation of said lamp housing from said first position to said second position when pulled.

2. A lamp according to claim 1 wherein said attachment means is a line-retaining means having an opening for releasing the line means when said line-retaining means is positioned substantially opposite to said line guide means, and co-operating means are provided on the lamp housing and the battery box, respectively, for retaining the lamp housing in a ready-for-use position until a sufficient force is imparted to the lamp housing to surmount the retaining force of said co-operating means.

3. A lamp according to claim 1, including two contact springs in said battery housing which are each in one piece and make contact with a battery pole and a terminal of said light-source means, respectively, one contact spring being so designed and located so as to serve both as an actual contact means and as a return spring for the light source means.

4. A lamp according to claim 1, wherein the lamp housing has an abutting surface for a ring which is present on the light source means.

5. A lamp according to claim 3, wherein said one contact spring is capable of permanently securing the light source means to the lamp housing during the rotation thereof.

6. A lamp according to claim 1, wherein the upper end of the lamp housing is provided with a removable lens ring.

7. A lamp according to claim 1, wherein said attachment means comprises a ring positioned around said lamp housing, said ring including a protrusion to which said means is attached.

8. A lamp according to claim 7, wherein said ring includes a plurality of circumferentially spaced protrusions, said means being attached to one of said plurality of protrusions or between two of said protrusions.

9. A lamp according to claim 1, wherein said line guide means comprises a flange which protrudes away from said battery housing, said flange defining an eye through which said line means extends, and a flexible plug which extends into said eye to position said line means therein yet allow said line means to be pulled away from said attachment means.

* * * * *